United States Patent [19]

Homma

[11] 4,034,323

[45] July 5, 1977

[54] MAGNETIC RELAY

[75] Inventor: Rokuro Homma, Tokyo, Japan

[73] Assignee: Oki Electric Industry Company, Ltd., Tokyo, Japan

[22] Filed: Mar. 24, 1975

[21] Appl. No.: 561,379

[52] U.S. Cl. ..... 335/129; 335/133

[51] Int. Cl.² ..... H01H 67/02

[58] Field of Search ..... 335/121, 124, 128, 129, 335/133

[56] References Cited

UNITED STATES PATENTS

| | | | |
|---|---|---|---|
| 2,852,639 | 9/1958 | Nelsen | 335/124 |
| 2,962,804 | 12/1960 | Nelsen | 335/133 X |
| 3,001,049 | 9/1961 | Didier | 335/124 X |
| 3,321,722 | 5/1967 | Cohen | 335/128 |
| 3,824,511 | 7/1974 | Aidn et al. | 335/133 X |

*Primary Examiner*—George Harris
*Attorney, Agent, or Firm*—Kenyon & Kenyon

[57] ABSTRACT

A magnetic relay having a core, coil, an armature with a pair of dielectric cards, a plurality of pairs of contact points and a contact spring, has been found. One of said dielectric cards pushes or releases the contact spring according to the electric current flowing in said coil and said pairs of contact points are closed or opened. The structure of the present relay is so simple that mass production and improvement of accuracy of the relay can be easily accomplished.

5 Claims, 9 Drawing Figures

(B)

MAGNETIC RELAY

BACKGROUND OF THE INVENTION

The present invention relates to a structure of an electro-magnetic relay, in which mass production and/or assembling of the relay are easy and the accuracy of structure of the contacts is improved.

The supporting point of an armature of a relay in a prior art has a spindle or a knife-edge. With the spindle type supporting point, it is necessary to make a hole in the armature and to weld a spindle thereto. Thus, the number of the manufacturing process is increased and, further, the flatness of the armature is destroyed since the center of the armature has a curved shape. With the knife-edge type supporting point, a special cutting process for cutting a V-shaped slit in the armature is necessary and the flatness of the armature is also destroyed due to said V-shaped cutting. That is to say, a prior relay has the disadvantage that some additional manufacturing process on the armature is necessary after pressing the armature and, therefore, the number of manufacturing processes are increased and the flatness of the armature is destroyed.

SUMMARY OF THE INVENTION

It is an object, therefore, of the present invention to overcome the disadvantages of the above-mentioned prior relay by providing a new and improved structure of a relay.

The above and other objects are attained by a relay comprising a core, a coil, an armature with a pair of dielectric cards, a plurality of pairs of contact points and a contact spring. One of said dielectric cards pushes or releases the contact spring according to the electric current flowing in said coil, and said pairs of contact points are closed or opened.

BRIEF DESCRIPTION OF THE DRAWINGS

The foregoing and other objects, features, and attendant advantages of the present invention will be appreciated as the same become better understood by the accompanying drawings wherein:

FIG. 4(A) and FIG. 4(B) show the embodiment of the patterns for producing the contact assembly of FIG. 3;

DETAILED DESCRIPTION OF THE PREFERRED EMBODIMENTS

Figure 1:
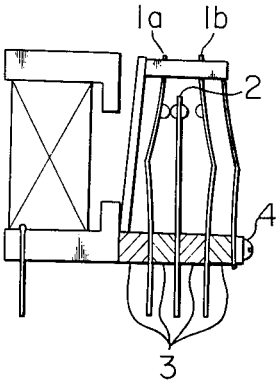
Fig. 1 PRIOR ART
FIG. 1 shows a structure of a relay of a prior art.

FIG. 1 shows a structure of the prior relay, in which a plurality of traveling contact springs 1*a*, 1*b* and fixed contact springs 2 are laminated with a dielectric member 3. The lamination is fixed on a body by a bolt 4. However, the relay of FIG. 1 has the previously mentioned drawbacks of the prior art and, in addition, other disadvantages in that many parts for assembling the relay are necessary and that, since the accuracy of a relay depends upon the accuracy of the parts, mass production of the relay is very difficult.

Figure 2:
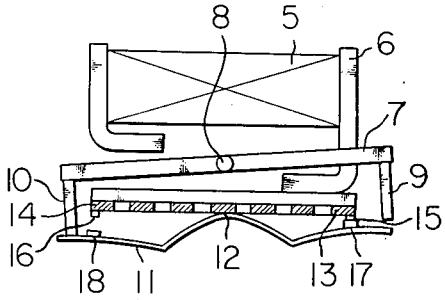
FIG. 2 is a side view of an embodiment of the relay according to the present invention.

FIG. 2 shows a side view of a first embodiment of the present relay which overcomes the drawbacks of the prior relays. In FIG. 2, the reference number 5 is an exciting coil, 6 is a yoke and 7 is an armature, which is pivotably supported at the center by a pin 8. At the ends of the armature 7, a pair of dielectric cards 9 and 10 are provided, and at one end of the armature 7 a slit (not shown) is provided for receiving the yoke 6. The element 11 is a W-shaped contact spring, the center of which is fixed to a supporting terminal or a supporting contact 12. A pair of contacts 17 and 18 are provided on the ends of the spring 11 so that said contacts 17 and 18 face corresponding contacts 15 and 16, respectively. A coil spring (not shown) is provided on the armature 7 so that the contacts 16 and 18 are opened and the other contacts 15 and 17 are closed by said coil spring when the exciting coil 5 is not energized.

When the exciting coil 5 is energized, the yoke 6 is magnetized, and the armature 7 is turned by the magnetic force applied between the armature 7 and the yoke 6. This causes the card 9 at one end of the armature 7 to push down the related end of the contact spring 11, and the other card 10 at the other end of the armature 7 releases the pressure on the other end of the contact spring 11. Therefore, the contacts 15 and 17 are opened and the contacts 16 and 18 are closed. It should be appreciated from the above explanation that a pair of contacts 13 and 14 are switched on or off alternatively between the center of the supporting contact 12, moving like a seesaw.

Figure 3:
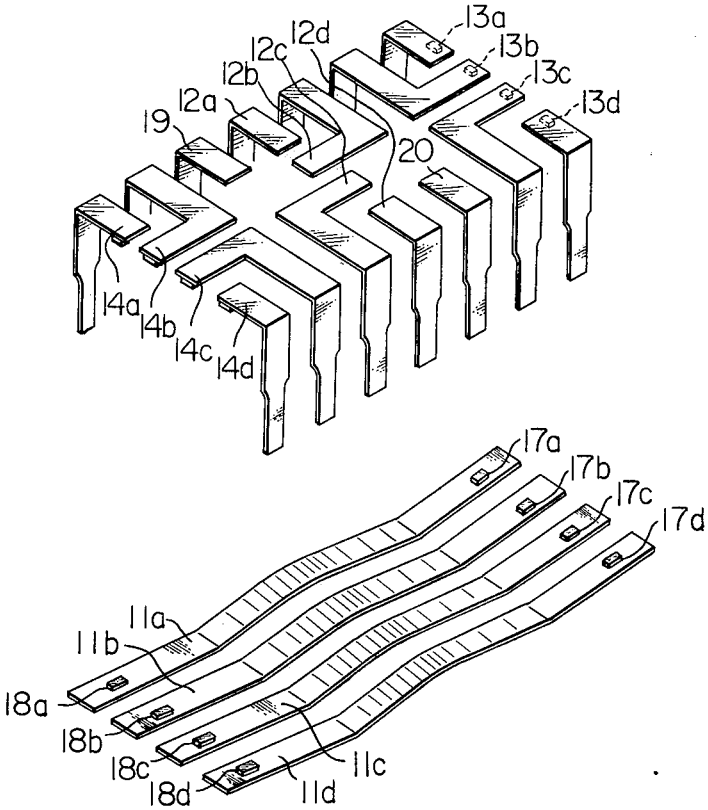
FIG. 3 is a perspective view of a contact assembly of the relay according to the present invention.

FIG. 3 shows a perspective view of a contact assembly of the relay of FIG. 2. In FIG. 3, a relay having four pairs of transfer contacts is shown. Contact springs 11*a*, 11*b*, 11*c* and 11*d* having contact points 17*a*, 17*b*, 17*c*, 17*d*, respectively at one of the ends and other contact points 18*a*, 18*b*, 18*c*, 18*d*, respectively, at the other ends, are fixed at their centers to the supporting terminals 12*a*, 12*b*, 12*c* and 12*d*, respectively. The four pairs of make-contacts are provided between the contact points 13*a*, 13*b*, 13*c*, 13*d* and 17*a*, 17*b*, 17*c*, 17*d*, respectively, and the four pairs of break-contacts are provided between the contact points 14*a*, 14*b*, 14*c*, 14*d* and 18*a*, 18*b*, 18*c*, 18*d*, respectively. The reference numbers 19 and 20 show a pair of input terminals to the exciting coil 5.

Figure 4A:
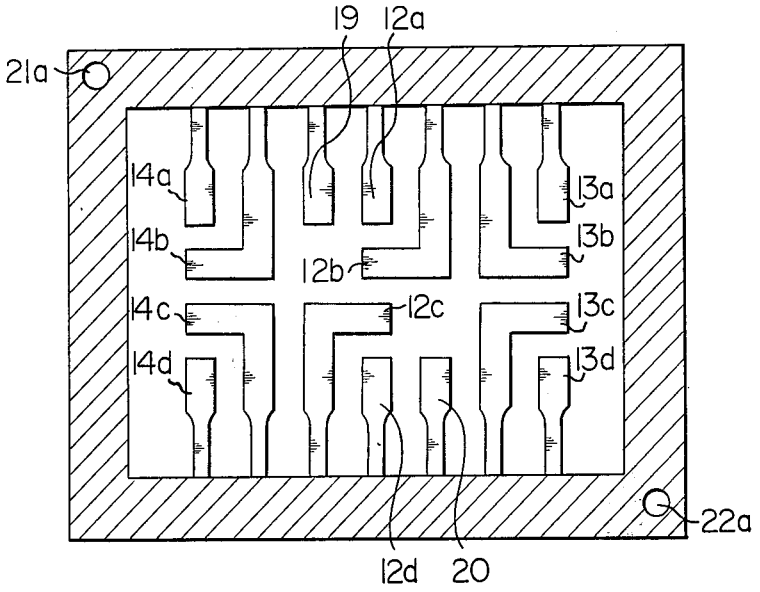
Figure 4A:
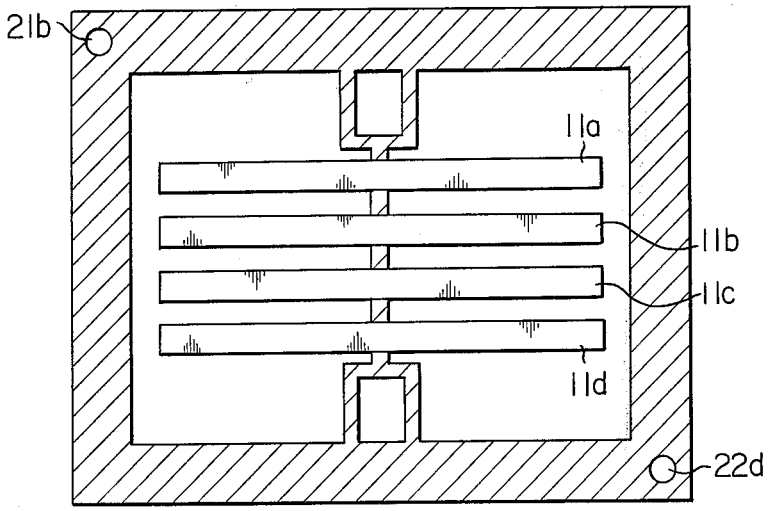

FIG. 4(A) and FIG. 4(B) show the embodiments of the patterns for manufacturing the contact assembly of FIG. 3. The pattern of FIG. 4(A) is that of supporting terminals 12*a* through 12*d*, contact terminals 13*a* through 13*d* and 14*a* through 14*d*, and input terminals 19, 20 for the exciting coil 5. The pattern of FIG. 4 (B) is that of the contact springs 11*a* through 11*d*.

The contact assembly is manufactured by the press process or the etching process with the patterns of FIG. 4(A) and FIG. 4(B). A contact point is attached on each contact terminal and contact spring and, next, the contact spring is provided with a predetermined curve or bend. After the above process, the pattern of FIG. 4(A) is laid on the pattern of FIG. 4(B) with reference guide holes 21*a* and 22*a* coinciding with guide holes 21*b* and 22*b*, respectively, and the centers of each of the contact springs are welded on the supporting terminals. After that, the unnecessary portions (shaded portions in FIG. 4(A) and FIG. 4(B) are removed and, thus, the contact assembly of FIG. 3 is completed.

The contact point on the contact can be produced either by a welding process or by providing a conductive layer on the contact terminal and/or the contact spring. Although the embodiment shows four pairs of contacts, the number of pairs of contacts can, of course, be designed at random.

The relay mentioned above is very advantageous since the number of parts is smaller than that of a prior relay, and the manufacturing and assembling process of the parts is easy. Therefore the mass production of relays of high quality is possible.

Figure 5:
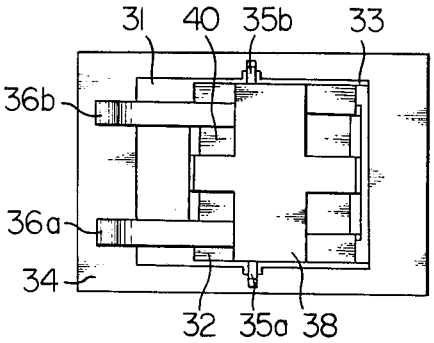
FIG. 5 is a plane view of the other embodiment of the relay according to the present invention.
Figure 6:
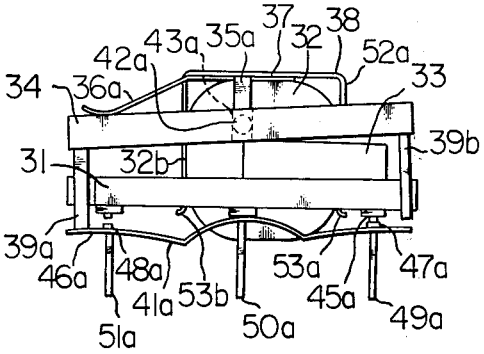
FIG. 6 is a side view of the relay shown in FIG. 5.
Figure 7:
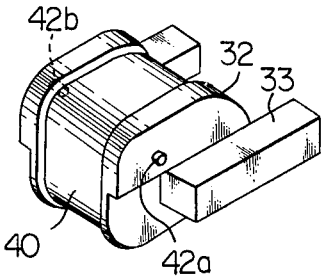
FIG. 7 and FIG. 8 are disassembled perspective views of some main parts of the relay of FIG. 5.
Figure 7:
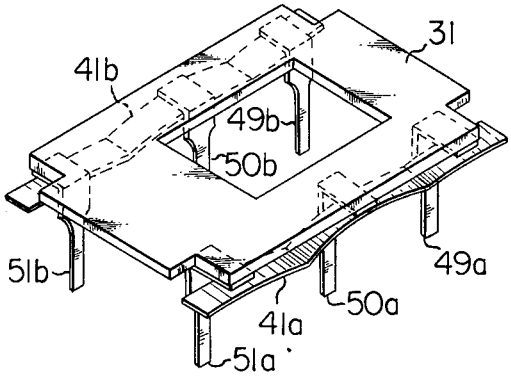
Figure 8:
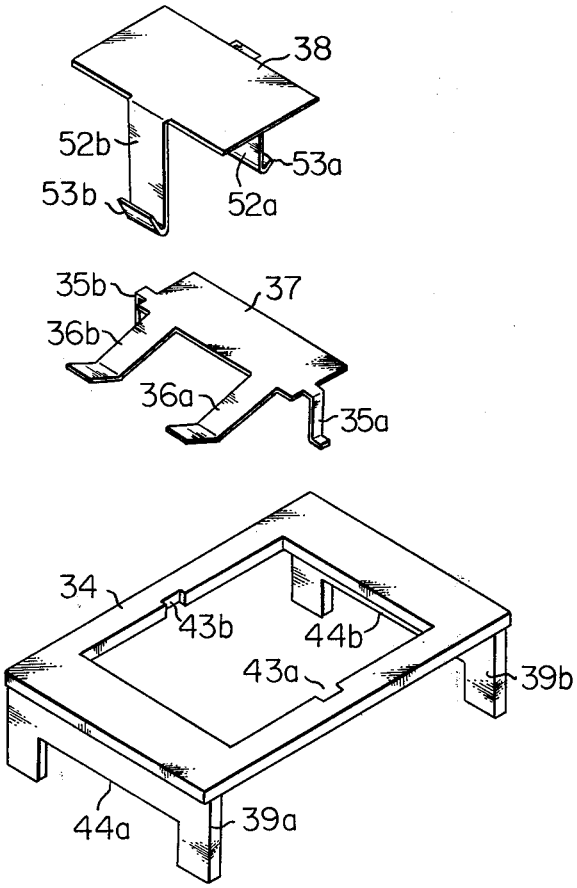

The second embodiment of the present invention will now be explained with reference to FIGS. 5 through 8, in which FIG. 5 is a plane view, FIG. 6 is a side view, and FIGS. 7 and 8 are perspective views of main portions of the relay.

In FIG. 5 and FIG. 6, the reference number 31 is a dielectric support, 32 is a bobbin, 33 is a core and 34 is an armature; 35*a* and 35*b* are supporting springs, 36*a* and 36*b* are balance springs, 37 is a supporting plate and 38 is a bind member; 39*a* and 39*b* are cards, 40 is a coil, 41*a* is a contact spring and 42*a* is a round pin; 43*a* is a hollow in the armature 34; 45*a*, 46*a*, 47*a* and 48*a* are contact points, 49*a* is a contact terminal and 50*a* is a supporting terminal; 51*a* is a contact terminal, 52*a* and 52*b* are bind springs, and 53*a* and 53*b* are the ends of said bind springs 52*a* and 52*b*, respectively.

The detailed structure of the present relay will be described with reference to FIG. 7 and FIG. 8.

In FIG. 7, the dielectric support 31 has a center hollow and notches at each corner. The elements 49*a*, 49*b*, 50*a*, 50*b*, 51*a* and 51*b* are conductive terminals, each having a right angle, and are fixed on the support 31. Each of the terminals 49*a*, 49*b*, and 51*a* and 51*b* has a contact point (not shown) at the end thereof. The center of the supporting terminals 50*a* and 50*b* are fixed and connected electrically to the W-shaped contact springs 41*a* and 41*b*, respectively. The W-shaped contact springs 41*a* and 41*b* have contact points at their ends facing the corresponding contact points of the contact terminals 49*a*, 49*b*, 51*a* and 51*b*. The two ends of the contact springs 41*a* and 41*b* are positioned in the notches at the corresponding corners of the dielectric support 31. The reference number 33 in FIG. 7 is a U-shaped core, which is surrounded by the boddin 32, around which the coil 40 is wound.. Each side of the bobbin 32 has a projected pin, 42*a*, 42*b*. The centers of the pins 42*a* and 42*b* are positioned so as to coincide with the edge of the core 33.

In FIG. 8, the frame type armature 34 having a center hollow and a pair of notches 43*a* and 43*b*, has a pair of dielectric cards 39*a* and 39*b*, which have notches 44*a* and 44*b*, respectively. The reference number 37 is a supporting plate which has a supporting spring, 35*a* and 35*b*, at each side and a pair of balance springs 36*a* and 36*b*. These springs 35*a*, 35*b*, 36*a* and 36*b* are bent downward. The bind member 38 has a bind spring, 52*a* and 52*b*, on each side. The ends 53*a* and 53*b* of the bind springs 52*a* and 52*b* are bent so that the same can catch the end of the hollow of the dielectric support 31*a*.

In FIGS. 5 through 8, the assembly having the core 33, the coil 40 and the bobbin 32 is positioned on the dielectric support 31, and the armature 34 is movably connected to the pins 42*a* and 42*b* so that these pins 42*a* and 42*b* are inserted in the notches 43*a* and 43*b* of the armature 34. The bind member 38 connects said assembly and the armature to the dielectric supporting 31 through the supporting plate 37. In the above construction, the supporting springs 35*a* and 35*b* provide a pressure on the portion near the notches 43*a* and 43*b* of the armature 34, and the balance springs 36*a* and 36*b* provide a pressure on the end of the armature 34. Therefore, the end of one of the notches 44*a* or 44*b* of the card 39*a* or 39*b* is touched by the dielectric support 31.

In the above-mentioned magnetic relay, when an electric current flows in the coil 40, the armature 34 is revolved around the supporting point of the pair of pins 42*a* and 42*b* of the bobbin 32 by the magnetic force between the core 33 and the armature 34. Then, the edge of the card 39*a* pushes down the ends of the contact springs 41*a* and 41*b*, and the edge of the other card 39*b* releases the pressure on the other edges of the contact springs 41*a* and 41*b*. Thus, the contact points 45*a* and 47*a* are opened and the other contact points 46*a* and 48*a* are closed. That is to say, the contact terminals 49*a*, 49*b* and 51*a*, 51*b*, and the supporting terminals 50*a*, 50*b* work as transfer type contacts.

As mentioned above, all parts including the core and armature of the magnetic relay of the second embodiment are simple in structure and can be manufactured by a simple press process. Therefore, the core and the armature are so flat that compared to the prior art the efficiency of the magnetic circuit is improved and the number of processes in assembling is reduced. Accordingly a magnetic relay of small size and low price can be obtained.

From the foregoing, it will now be apparent that a new and improved magnetic relay has been found. It should be understood, of course, that the embodiments disclosed are merely illustrative and are not intended to limit the scope of the invention. Reference should be made to the appended claims, therefore, rather than the specification as indicating the scope of the invention.

What is claimed is:

1. A magnetic relay comprising a core, a coil wound on said core, an armature positioned movably near said core by magnetic force, and a plurality of pairs of contact points, each pair of which being arranged so as to be able to open and close according to the movement of said armature, characterized in that said relay further comprises a contact spring the center of which is fixed, and the side portions of which extend from said center and are each provided at their respective ends with some of said contact points, a pair of dielectric card means, one of which means is affixed to one end of said armature and in response to a magnetic force on said one end forcibly engages one of said side portions to open a contact on the end thereof, and the other end of which means is affixed to the other end of said armature and in response to a force on said armature forcibly engages the other of said side portions to open a contact on the end thereof, and a dielectric support plate having a support surface for supporting one of the contacts of each of said contact pairs whose other contact is provided on said contact spring.

2. A magnetic relay in accordance with claim 1 in which:

said support plate is disposed with said support surface facing away from said armature and toward the surface of said spring which is provided with contacts;

and each dielectric card means is arranged to cross said support surface when forcibly engaging its respective side portion of said contact spring.

3. A magnetic relay in accordance with claim 2 further including:

a number of lead terminals each including a portion which is affixed to said support surface and which is attached to one of the contacts supported by said surface;

and a further lead terminal supported by said support surface so as to engage the central portion of said spring.

4. A magnetic relay in accordance with claim 1 in which:

said support plate has an aperture through which a portion of said core extends and regions adjacent said aperture which support said core;

said relay includes projections which extend from opposite end faces of said core;

and said armature is rotatably supported on said projections.

5. A magnetic relay in accordance with claim 4 in which:

said relay further includes a bobbin which surrounds said core and upon which said coil is wound, said bobbin having pins projecting from opposite sides thereof to form said projections;

and said armature has an aperture through which a portion of said bobbin extends and whose sides rotatably engage said pins.

* * * * *

UNITED STATES PATENT AND TRADEMARK OFFICE

CERTIFICATE OF CORRECTION

PATENT NO. : 4,034,323

DATED : July 5, 1977

INVENTOR(S) : Rokuro Homma

It is certified that error appears in the above-identified patent and that said Letters Patent are hereby corrected as shown below:

Col. 3, line 68 - change "supporting" to --support--.

Col. 4, line 55 - change "end" second occurrence to -- one --.

Col. 6, line 4 - after "relay" insert --further--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*